US009289894B2

(12) United States Patent
Johnson et al.

(10) Patent No.: US 9,289,894 B2
(45) **Date of Patent: *Mar. 22, 2016**

(54) HAND TOOL WITH MULTIPLE BIT STORAGE AND A METHOD FOR USING THE SAME

(75) Inventors: Ronald L. Johnson, San Jose, CA (US); Robert J. Gallegos, Fremont, CA (US); Steven Simas Escobar, San Jose, CA (US); Anders Scot Hudson, Campbell, CA (US); Idriss Mansouri-Chafik Ruiz, San Jose, CA (US); Yugen Patrick Lockhart, Palo Alto, CA (US); Howard Allen Wilson, Santa Clara, CA (US); Eric M. Colton, Torrance, CA (US)

(73) Assignee: Wagic, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/206,282

(22) Filed: Aug. 9, 2011

(65) Prior Publication Data

US 2011/0290088 A1 Dec. 1, 2011

Related U.S. Application Data

(62) Division of application No. 11/803,032, filed on May 10, 2007, now Pat. No. 8,011,277.

(51) Int. Cl.
*B25G 1/08* (2006.01)
*B25H 3/00* (2006.01)

(52) U.S. Cl.
CPC ..... *B25G 1/085* (2013.01); *B25H 3/003* (2013.01)

(58) Field of Classification Search
CPC ..... B25G 1/085; B25G 1/066; B25G 1/08; B25B 15/008; B25B 13/56; B25H 3/003
USPC ..... 15/177.4, 490, 437–439; 206/373–379; D8/85; 81/177.4, 490, 437–439
See application file for complete search history.

(56) References Cited

U.S. PATENT DOCUMENTS

| | | | |
|---|---|---|---|
| 244,309 | A | 7/1881 | Rhodes |
| 363,331 | A | 5/1887 | Hammer |
| 364,422 | A | 6/1887 | Laforge |
| 647,528 | A | 4/1900 | Schmidt |
| 763,745 | A | 6/1904 | Gheen |
| 873,363 | A | 12/1907 | Ross |
| 875,493 | A | 12/1907 | Beard |
| 959,408 | A | 5/1910 | Volbert |
| 1,000,900 | A | 8/1911 | Dorsey |

(Continued)

FOREIGN PATENT DOCUMENTS

| | | |
|---|---|---|
| CA | 1147176 | 5/1983 |
| CA | 1232781 A | 2/1988 |

(Continued)

*Primary Examiner* — Robert Scruggs
(74) *Attorney, Agent, or Firm* — Haverstock & Owens LLP

(57) ABSTRACT

A hand tool and bit storage device configured to allow easy storage and access to a wide variety of bits. The hand tool comprises a body portion, a stem portion and a bit interface. The hand tool couples with the storage device. The storage device holds one or more tool frames or bit inserts each comprising a plurality of bits. The bit inserts are deformable to allow easy access to the bits contained therein. In some embodiments, the bit inserts may be locked in the storage device.

16 Claims, 6 Drawing Sheets

(56) References Cited

U.S. PATENT DOCUMENTS 1,006,679 A 10/1911 Rice
1,100,070 A 6/1914 Graham
1,172,656 A 2/1916 Yorgensen
1,187,842 A 6/1916 Kaas
D53,597 S 7/1919 Marcmann
1,398,583 A 11/1921 Bovee
1,425,270 A 8/1922 Morgan
1,500,852 A 7/1924 Shepard
1,502,044 A 7/1924 McCann
1,530,905 A 3/1925 Nance
1,559,097 A 10/1925 Hill
1,753,026 A 4/1930 Rosati
1,825,936 A 10/1931 Bodmer
1,888,222 A 11/1932 Curtis et al.
1,915,245 A 6/1933 Cook
1,944,606 A 1/1934 Little
1,970,409 A 8/1934 Wiedemann
2,236,333 A 3/1941 Cowles
2,332,656 A 10/1943 Mirando
2,346,364 A 4/1944 Dowe
D142,982 S 11/1945 Bloomfield
2,409,613 A 10/1946 Brooks
2,410,971 A 11/1946 Hartley
2,465,152 A 3/1949 Ellison
2,465,619 A 3/1949 Veit
2,475,268 A 7/1949 Wittle
2,485,991 A 10/1949 Stowell
D156,677 S 12/1949 Smith
D157,154 S 2/1950 Horton
2,509,507 A 5/1950 Kane
2,512,967 A 6/1950 Quiron
2,530,024 A 11/1950 Moody
2,532,636 A 12/1950 Minnich
2,569,069 A 9/1951 Motel
2,590,307 A 3/1952 Gibson
2,593,828 A 4/1952 Arey
2,604,211 A 7/1952 Steine
2,701,052 A 2/1955 Martel
D175,056 S 6/1955 Wilson
2,715,028 A 8/1955 Dossie
2,719,042 A 9/1955 Epsy
2,726,091 A 12/1955 Topar
2,776,589 A 1/1957 Gregory
2,778,396 A 1/1957 Swain
D179,979 S 4/1957 Noga
2,797,599 A 7/1957 McGarvie
2,800,816 A 7/1957 Tasciotti
2,804,970 A 9/1957 Kuc et al.
2,810,472 A 10/1957 Midkiff
2,836,210 A 5/1958 Garofalo
2,842,020 A 7/1958 Traquinio
2,844,244 A 7/1958 Hanson
2,851,915 A 9/1958 Martinez
2,854,741 A 10/1958 Cholger
2,878,701 A 3/1959 Weersma
3,023,054 A 2/1962 Shigekuni
3,061,927 A 11/1962 Von Frankenberg Und Ludwingdorf
3,113,479 A 12/1963 Swingle
3,156,143 A 11/1964 Wolf
3,222,959 A 12/1965 Clark
3,255,792 A 6/1966 Beck
3,257,991 A 6/1966 Mosch
D205,745 S 9/1966 Namfeldt
3,342,229 A 9/1967 Janes
3,343,434 A 9/1967 Schroeder
3,370,696 A 2/1968 Groe
3,424,039 A 1/1969 Scott
3,592,086 A 7/1971 Derwin
3,654,975 A 4/1972 Ballsmith et al.
3,667,518 A 6/1972 Stillwagon, Jr.
3,707,893 A 1/1973 Hofman
3,733,936 A 5/1973 Flynn
3,802,286 A 4/1974 Winklofer et al.
3,863,693 A 2/1975 Carniker
3,943,801 A 3/1976 Yates
3,958,469 A 5/1976 Meese
3,997,053 A 12/1976 Bondhus
4,000,767 A 1/1977 Geng
4,043,230 A 8/1977 Scrivens
4,124,915 A 11/1978 Schlicher
4,154,125 A 5/1979 Frank
4,196,761 A 4/1980 Royer
4,227,430 A 10/1980 Jameson et al.
4,235,269 A 11/1980 Kraus
4,238,862 A 12/1980 Leatherman
4,241,773 A 12/1980 Personnat
4,302,990 A 12/1981 Chrichton et al.
4,308,770 A 1/1982 MacDonald
4,310,094 A 1/1982 Hotchkiss
4,327,790 A 5/1982 Stevens et al.
4,384,499 A 5/1983 Shockley
D270,024 S 8/1983 Strasser
4,424,728 A 1/1984 MacDonald
4,448,097 A 5/1984 Rocca
4,469,109 A 9/1984 Mehl
4,476,751 A 10/1984 Mishima
4,525,889 A 7/1985 Dunau
4,542,667 A 9/1985 Jang
D284,810 S 7/1986 Kelemen, Sr.
4,598,822 A 7/1986 Hemmings
4,621,718 A 11/1986 DeCarolis
4,640,155 A 2/1987 Condon
4,699,020 A 10/1987 Bush et al.
4,699,030 A 10/1987 Yang
4,703,673 A 11/1987 Allen
4,711,353 A 12/1987 Rozmestor
4,716,795 A 1/1988 Corona et al.
4,716,796 A 1/1988 Corona et al.
4,767,006 A 8/1988 Wasem
4,783,867 A 11/1988 Tsao
4,787,276 A 11/1988 Condon
4,815,346 A 3/1989 Littlehorn
4,819,523 A 4/1989 Souza
4,819,800 A 4/1989 Wilson
4,820,090 A 4/1989 Chen
D302,102 S 7/1989 Amagaya
4,882,841 A 11/1989 Margolis
4,922,569 A 5/1990 Brinker et al.
4,926,721 A 5/1990 Hsiao
D308,462 S 6/1990 Komatsu
4,934,223 A * 6/1990 Wong ..... 81/490
D310,770 S 9/1990 Zamarripa
D311,124 S 10/1990 Learney
4,960,016 A 10/1990 Seals
4,974,477 A 12/1990 Anderson
4,979,407 A 12/1990 Hernandez et al.
5,029,707 A 7/1991 Feng
5,036,975 A 8/1991 Chow
5,042,658 A 8/1991 Tiramani et al.
5,062,173 A 11/1991 Collins et al.
5,063,796 A 11/1991 Gennep
5,065,487 A 11/1991 Yother
5,086,674 A 2/1992 Her
5,146,815 A 9/1992 Scott, III
5,147,038 A 9/1992 Pergeau
D333,769 S 3/1993 Jureckson
D334,516 S 4/1993 Tsunoda
D339,048 S 9/1993 Baum
5,251,352 A 10/1993 Cullison
5,263,389 A 11/1993 Frazzell et al.
5,265,504 A 11/1993 Fruhm
D342,433 S 12/1993 Sorenson
5,271,300 A 12/1993 Zurbuchen et al.
D343,106 S 1/1994 Eklind et al.
5,295,422 A 3/1994 Chow
5,320,004 A 6/1994 Hsiao
5,394,984 A * 3/1995 Aiba ..... 206/377
D359,671 S 6/1995 Acosta
5,450,774 A 9/1995 Chang
5,461,950 A 10/1995 Iwinski
D365,681 S 1/1996 Chow
5,480,166 A 1/1996 Milsop
5,495,942 A 3/1996 Ishak

(56) References Cited

U.S. PATENT DOCUMENTS 5,499,560 A 3/1996 Aeschliman
5,499,562 A 3/1996 Feng
5,505,316 A 4/1996 Lee
5,517,885 A 5/1996 Feng
5,522,291 A 6/1996 Liu
5,535,882 A 7/1996 Liu
5,542,322 A 8/1996 Knox et al.
D373,943 S 9/1996 Fuhrmann
5,553,340 A 9/1996 Brown, Jr.
5,566,596 A 10/1996 Lin
D376,520 S 12/1996 Morin
5,581,834 A 12/1996 Collins
D377,444 S 1/1997 Lin
5,592,859 A 1/1997 Johnson et al.
D378,797 S 4/1997 Poremba et al.
580,235 A 4/1997 Strum
D380,131 S 6/1997 Sung
D382,190 S 8/1997 Blackston et al.
5,653,525 A 8/1997 Park
D383,048 S 9/1997 Sorenson et al.
5,662,013 A * 9/1997 Lin ..... 81/490
D385,172 S 10/1997 Bramsiepe et al.
D386,955 S 12/1997 Jones et al.
5,692,656 A 12/1997 Dembicks
D388,609 S 1/1998 Chan
5,711,042 A 1/1998 Chuang
5,711,194 A 1/1998 Anderson et al.
D394,792 S 6/1998 Bourque
D394,794 S 6/1998 Vasudeva
5,758,870 A 6/1998 Weaver
5,765,247 A 6/1998 Seber et al.
5,765,454 A 6/1998 Barbulescu et al.
5,768,960 A 6/1998 Archuleta
5,791,211 A 8/1998 Bondhus et al.
5,803,584 A 9/1998 Chung
5,816,401 A 10/1998 Vasudeva et al.
5,820,288 A 10/1998 Cole
5,822,830 A 10/1998 Lin
D400,775 S 11/1998 Hsu
5,855,274 A 1/1999 Piao
D405,335 S 2/1999 Lin
D408,253 S 4/1999 Rowlay
5,911,799 A 6/1999 Johnson et al.
5,916,277 A 6/1999 Dallas
5,916,341 A * 6/1999 Lin ..... 81/437
5,918,513 A 7/1999 Ho
5,918,741 A 7/1999 Vasudeva
5,938,028 A 8/1999 Hu
5,970,828 A 10/1999 Bondhus et al.
D415,946 S 11/1999 Tsai
5,983,759 A 11/1999 Turner
5,992,626 A 11/1999 Anderson
D418,731 S 1/2000 Rowlay et al.
D420,885 S 2/2000 Lin
6,032,332 A 3/2000 Lin
6,032,796 A * 3/2000 Hopper et al. ..... 206/377
1,337,769 A 4/2000 Hemming
6,044,973 A 4/2000 Vasudeva
D426,449 S 6/2000 Eklind
D426,450 S 6/2000 Eklind
D427,875 S 7/2000 Chiu
6,085,620 A 7/2000 Anderson et al.
6,088,861 A 7/2000 Sessions et al.
6,089,133 A 7/2000 Liao
6,092,656 A 7/2000 Ernst
6,095,018 A 8/2000 Schuster
6,105,767 A 8/2000 Vasudeva
6,128,981 A 10/2000 Bondhus et al.
6,131,740 A 10/2000 Huang
D433,613 S 11/2000 Jailin
D433,910 S 11/2000 Oliver et al.
6,151,998 A 11/2000 Fu-Hui
D435,415 S 12/2000 Johnson et al.
6,164,172 A 12/2000 Huang
D435,773 S 1/2001 Lin
D437,541 S 2/2001 Hermansen et al.
D437,763 S 2/2001 Oliver et al.
6,186,785 B1 2/2001 Rogers et al.
6,202,864 B1 3/2001 Ernst et al.
6,206,189 B1 3/2001 Huot, Jr. et al.
D440,852 S 4/2001 Ernst
6,233,769 B1 5/2001 Seber et al.
6,237,451 B1 5/2001 Wei
6,257,106 B1 7/2001 Anderson et al.
6,260,453 B1 7/2001 Anderson et al.
6,279,434 B1 8/2001 Brown
6,279,435 B1 8/2001 Zayat, Jr.
6,295,903 B1 10/2001 Tipper et al.
6,305,248 B1 10/2001 Rowlay
6,308,599 B1 10/2001 Fu-Hui
6,311,587 B1 11/2001 Johnson et al.
6,314,838 B2 11/2001 Wall
6,318,218 B1 11/2001 Anderson et al.
6,332,381 B1 12/2001 Vasudeva
6,345,557 B1 2/2002 Kuo
D454,766 S 3/2002 Lin
6,357,068 B1 3/2002 Seber et al.
D455,630 S 4/2002 Chiu
6,371,290 B1 4/2002 Yearous et al.
6,378,402 B1 4/2002 Kalomeris et al.
6,382,057 B1 5/2002 Kienholz
6,389,931 B1 5/2002 Delaney et al.
6,397,709 B1 6/2002 Wall
6,401,576 B1 6/2002 Wu
6,401,923 B1 6/2002 Huang
6,405,620 B2 6/2002 Liao
D459,967 S 7/2002 Johnson et al.
D461,311 S 8/2002 Gharib
6,427,564 B1 8/2002 Nelson
6,490,954 B2 12/2002 Johnson et al.
6,510,767 B1 1/2003 Rivera
D470,739 S 2/2003 Chen
D472,712 S 4/2003 Sagen
D472,931 S 4/2003 Leins
6,564,680 B1 5/2003 Rinner et al.
6,598,503 B1 7/2003 Cunningham
6,601,481 B2 8/2003 Chuang
6,606,925 B1 8/2003 Gmeilbauer
D479,963 S 9/2003 Chang
6,634,502 B1 10/2003 Yu
6,640,675 B1 11/2003 Chuang
6,675,678 B2 1/2004 Liu
6,698,318 B2 * 3/2004 Peters ..... 81/177.4
6,701,813 B2 3/2004 Hu
6,709,196 B1 3/2004 Medendorp
6,739,224 B1 5/2004 Wershe
6,751,819 B2 6/2004 Chuang
6,751,820 B1 6/2004 Wu
6,752,046 B1 6/2004 Lee
6,758,350 B2 7/2004 Lin
6,763,744 B2 7/2004 Johnson et al.
D494,438 S 8/2004 Falkenstein et al.
6,799,490 B1 10/2004 Chu
6,827,210 B2 12/2004 Chen
6,863,471 B2 3/2005 Medendorp
6,877,186 B2 4/2005 Shiao
6,898,998 B2 5/2005 Shyu
6,901,826 B2 6/2005 Huang
6,918,323 B2 7/2005 Arnold et al.
6,922,870 B2 8/2005 Tontz, Sr.
6,925,910 B2 8/2005 Alford
6,928,908 B1 8/2005 Yu
6,935,211 B2 8/2005 Chen
6,941,843 B2 9/2005 Johnson et al.
6,948,406 B1 9/2005 Li
6,968,758 B2 11/2005 Lin
6,988,616 B2 1/2006 Chen
7,028,593 B1 4/2006 Lin et al.
7,047,847 B2 5/2006 Chuang
7,051,626 B1 5/2006 Chen
7,051,629 B2 * 5/2006 Huang ..... 81/489
D523,637 S 6/2006 Chang
7,066,061 B1 6/2006 Chen et al.
7,073,418 B2 7/2006 Kuo

(56) References Cited

U.S. PATENT DOCUMENTS

| | | | | |
|---|---|---|---|---|
| 7,080,582 | B2 | 7/2006 | Karle | |
| 7,086,314 | B2 | 8/2006 | Wannop | |
| 7,093,519 | B1 | 8/2006 | Huang | |
| D527,903 | S | 9/2006 | Chan | |
| 7,100,476 | B1 | 9/2006 | Feit | |
| 7,131,358 | B2 | 11/2006 | Hsien | |
| 7,140,280 | B2 | 11/2006 | Hawkins et al. | |
| 7,143,669 | B2 | 12/2006 | Hu | |
| 7,150,208 | B2 | 12/2006 | Debley | |
| 7,155,998 | B1 | 1/2007 | Shyu | |
| 7,159,260 | B2 | 1/2007 | Hansen | |
| 7,159,491 | B1 | 1/2007 | Chaconas et al. | |
| 7,165,479 | B1 | 1/2007 | Lee | |
| 7,168,345 | B1 | 1/2007 | Hsieh | |
| 7,182,003 | B1 | 2/2007 | Hsieh | |
| 7,185,565 | B1 | 3/2007 | Hu | |
| 7,216,569 | B2 | 5/2007 | Abdelgany | |
| 7,237,463 | B1 | 7/2007 | Lee | |
| D548,464 | S | 8/2007 | Lin | |
| 7,284,466 | B1 | 10/2007 | Ho | |
| D557,099 | S | 12/2007 | Lin | |
| 7,305,908 | B2 * | 12/2007 | Chi | 81/177.4 |
| 7,409,894 | B1 | 8/2008 | Valentine | |
| 7,467,574 | B1 | 12/2008 | Lin | |
| 7,467,575 | B2 | 12/2008 | Lai | |
| 7,565,852 | B2 | 7/2009 | Yu | |
| 7,571,517 | B2 | 8/2009 | Smith et al. | |
| 7,600,640 | B2 * | 10/2009 | Hallee et al. | 206/373 |
| D604,509 | S | 11/2009 | Andrews | |
| 7,698,972 | B2 | 4/2010 | Hi | |
| 7,743,685 | B2 | 6/2010 | Chang | |
| D622,125 | S | 8/2010 | Robinson | |
| D623,037 | S | 9/2010 | Johnson et al. | |
| 7,810,415 | B2 | 10/2010 | Adamany et al. | |
| 7,815,058 | B2 | 10/2010 | Cheng | |
| 7,836,534 | B2 | 11/2010 | Simmons | |
| 7,846,203 | B2 | 12/2010 | Cribier | |
| 7,946,203 | B2 | 5/2011 | Johnson et al. | |
| 8,011,277 | B2 | 9/2011 | Johnson et al. | |
| 8,015,642 | B1 | 9/2011 | Oakley | |
| D650,257 | S | 12/2011 | Royes et al. | |
| 8,336,428 | B2 | 12/2012 | Johnson et al. | |
| 8,613,121 | B1 | 12/2013 | White | |
| 8,640,574 | B2 | 2/2014 | Johnson et al. | |
| 2001/0005576 | A1 | 6/2001 | Rogers et al. | |
| 2001/0045145 | A1 | 11/2001 | Legg | |
| 2003/0000902 | A1 | 1/2003 | Keis et al. | |
| 2003/0047474 | A1 | 3/2003 | Dahlson | |
| 2003/0126957 | A1 | 7/2003 | Huang | |
| 2003/0136234 | A1 | 7/2003 | Cunningham | |
| 2003/0188610 | A1 | 10/2003 | Lin | |
| 2003/0226428 | A1 | 12/2003 | Liu | |
| 2004/0050218 | A1 | 3/2004 | Napoli | |
| 2004/0173061 | A1 | 9/2004 | Liou | |
| 2004/0262344 | A1 | 12/2004 | White | |
| 2005/0011318 | A1 | 1/2005 | Tsai | |
| 2005/0199108 | A1 | 9/2005 | Jheng | |
| 2005/0229752 | A1 | 10/2005 | Nickipuck | |
| 2005/0247587 | A1 | 11/2005 | Holland-Letz | |
| 2005/0268754 | A1 | 12/2005 | Fa | |
| 2005/0284267 | A1 | 12/2005 | Liao et al. | |
| 2006/0042428 | A1 | 3/2006 | Chuang | |
| 2006/0101955 | A1 | 5/2006 | Chang | |
| 2006/0118500 | A1 | 6/2006 | Chen | |
| 2006/0150784 | A1 | 7/2006 | Hsieh | |
| 2006/0254396 | A1 | 11/2006 | Hu | |
| 2006/0288531 | A1 | 12/2006 | Hu | |
| 2006/0288823 | A1 | 12/2006 | Schepman | |
| 2007/0023306 | A1 | 2/2007 | Lai | |
| 2007/0044598 | A1 | 3/2007 | Frohm et al. | |
| 2007/0056117 | A1 | 3/2007 | Gardiner et al. | |
| 2007/0056872 | A1 | 3/2007 | Begim | |
| 2007/0062831 | A1 | 3/2007 | Chen | |
| 2007/0084740 | A1 | 4/2007 | Malek | |
| 2007/0141885 | A1 | 6/2007 | Chen | |
| 2007/0151402 | A1 | 7/2007 | Schneerman et al. | |
| 2007/0186731 | A1 | 8/2007 | Schnarr et al. | |
| 2007/0221017 | A1 | 9/2007 | Heaven | |
| 2007/0228672 | A1 | 10/2007 | Huang | |
| 2007/0245862 | A1 | 10/2007 | Gonzalez et al. | |
| 2007/0295171 | A1 | 12/2007 | Johnson et al. | |
| 2008/0128370 | A1 | 6/2008 | Shih | |
| 2008/0148909 | A1 | 6/2008 | Lai | |
| 2008/0156754 | A1 | 7/2008 | Cheng | |
| 2008/0164171 | A1 | 7/2008 | Meng | |
| 2008/0190249 | A1 | 8/2008 | Yu | |
| 2008/0202963 | A1 | 8/2008 | Liao | |
| 2008/0223179 | A1 | 9/2008 | Nash et al. | |
| 2008/0251402 | A1 | 10/2008 | Chiu | |
| 2008/0256816 | A1 | 10/2008 | Cosentino | |
| 2008/0271573 | A1 | 11/2008 | Lown et al. | |
| 2008/0295657 | A1 | 12/2008 | Cluthe | |
| 2009/0107303 | A1 | 4/2009 | Steinweg et al. | |
| 2009/0183608 | A1 | 7/2009 | Johnson et al. | |
| 2009/0183609 | A1 | 7/2009 | Johnson et al. | |
| 2009/0241740 | A1 | 10/2009 | Heagerty | |
| 2010/0258465 | A1 | 10/2010 | Gomas | |
| 2011/0000024 | A1 | 1/2011 | Johnson et al. | |
| 2011/0094910 | A1 | 4/2011 | Fleury et al. | |
| 2012/0012485 | A1 | 1/2012 | Wang | |
| 2013/0228484 | A1 | 9/2013 | Yang | |

FOREIGN PATENT DOCUMENTS

| | | | |
|---|---|---|---|
| CN | 2628230 | Y | 7/2004 |
| DE | 464002 | | 8/1928 |
| DE | 2035793 | B1 | 3/1972 |
| DE | 2453480 | A1 | 5/1976 |
| DE | 3744176 | A1 | 8/1989 |
| DE | 102004011892 | | 1/2005 |
| DE | 202004013404 | U1 | 3/2005 |
| DE | 20 2007 003841 | U1 | 9/2007 |
| EP | 856233 | | 12/1960 |
| EP | 503559 | A1 | 9/1992 |
| EP | 618046 | A1 | 10/1994 |
| EP | 01693163 | | 2/2006 |
| EP | 01777042 | | 4/2007 |
| FR | 787512 | | 9/1935 |
| JP | 57-13165 | | 1/1982 |
| JP | 61136778 | | 6/1986 |
| JP | 3-47775 | | 5/1991 |
| JP | 03103162 | | 10/1991 |
| JP | 4-29368 | | 3/1992 |
| JP | 5-31882 | | 4/1993 |
| JP | 08505812 | | 6/1996 |
| TW | I236402 | | 7/2005 |
| TW | M284496 | | 1/2006 |
| TW | M284500 | | 1/2006 |
| TW | M296765 | | 9/2006 |
| TW | I270445 | | 1/2007 |
| WO | 83/01406 | | 4/1983 |
| WO | 9412322 | A1 | 6/1994 |
| WO | 9623631 | | 8/1996 |
| WO | 97/29887 | | 8/1997 |

* cited by examiner

HAND TOOL WITH MULTIPLE BIT STORAGE AND A METHOD FOR USING THE SAME

RELATED APPLICATIONS

This Application is a divisional of U.S. patent application Ser. No. 11/803,032, filed on May 10, 2007 and entitled "HAND TOOL WITH MULTIPLE BIT STORAGE AND A METHOD FOR USING THE SAME," the contents of which is hereby incorporated by reference.

FIELD OF THE INVENTION

The present invention relates to hand tools capable of being used with multiple bits. More specifically, the present invention relates to a screwdriver removably coupled with a storage device which holds multiple driver bits, allows easy access to the bits and provides a method of using the screwdriver for projects requiring multiple bits.

BACKGROUND OF THE INVENTION

Carpenters, electricians, mechanics, other skilled workers and even lay people rely on a wide variety of tools to complete their work. Various tools and bits are frequently needed by these workers including screwdrivers, slotted screws, Phillips-Head screws and connections, pozidriv bits, torx bits, alien wrenches and screws, hex key bits, Robertson bits, tri-wing bits, torq-sets, spanner bits, drill bits, sockets of various shapes and sizes and the like.

Furthermore, the above-listed tools are needed in various sizes. For example, an automobile mechanic might need to loosen a large slotted screw. To achieve enough torque to loosen a large slotted screw, a large slot screwdriver is needed. However, this screwdriver would be useless to the same mechanic who wanted to loosen the tiny screws of a car audio system.

Tools requiring bits typically utilize a "loose bit" solution. According to this solution, a hand tool or similar tool is separate from the bit holder containing bits. Workers face several problems with this configuration due to the many components and the hassle corresponding to the methods of accessing them.

According to the "loose bit" solution, the user must set down the hand tool, pick up the bit holder with one hand, use the other hand to choose and access a desired bit from the bit holder, set down the bit holder and finally couple the selected bit to the hand tool. This traditional method of changing bits requires many parts, many steps and many motions.

Alternatively, a user of a "loose bit" tool system might attempt to hold the numerous tools simultaneously, for example, the driver, the bit holder, the current bit, the replacement bit, etc, as well as holding work pieces. This practice often times results in a load that is too heavy or awkward for the user to work dexterously and in a constant potential to drop one of these components. Finally, it is particularly difficult to perform the tasks required according to the "loose bit" solution while on a ladder or in other positions requiring great precision or balance.

Next, when utilizing a "loose bit" method, a user cannot conveniently test a bit for the proper fit with a screw or other work piece. Rather, the user must guess what size is appropriate, and then access bit after bit from a "loose bit" bit holder until the correct bit is found without a convenient way to "test fit" a bit.

Also, organizing all these tools is time consuming and takes up space. Furthermore, many tools come in both American and metric sizes. For example a ¼ inch allen wrench is very close in size to a 6 mm alien wrench. However, the two cannot be used interchangeably, requiring two sets of nearly identical wrenches. Next, tools are expensive and a carpenter can spend a lot of money buying the multiple screwdrivers, allen wrenches and other tools which are needed to do even a single job. Furthermore, traditional tool boxes and shelving can store many screwdrivers, wrenches and bits, but they do not provide an easy way to locate particular bits within the box.

SUMMARY OF THE INVENTION

A hand tool with a storage device is disclosed. In some embodiments of the invention, a ratchet is included on the hand tool. The ratchet alternatively allows either clockwise or counterclockwise rotation. In some embodiments of the present invention, a magnet is included on the hand tool's bit interface to provide strength to the interface. The hand tool is removably coupled to a bit storage device. The bit storage device holds bit inserts, which hold individual bits. In some aspects of the present invention, the hand tool itself accommodates bit inserts. In some embodiments of the present invention, the bit storage device holds multiple bit inserts. In some embodiments of the present invention, the bit storage device or the bit inserts are labeled according to the contents therein. The bit inserts are configured to bend and distort to more easily access the stored bits contained therein. The hand tool and bit insert are configured such that a user is able to access the bit insert, remove bits from the hand tool with the bit insert, access and couple a new bit from the bit insert to the hand tool, all without setting any pieces aside, allowing for fewer steps and motions and reducing the potential for dropping or losing bits. In some embodiments of the present invention, a locking system is utilized to keep the bit inserts in place. A finger grip allows a user easier access to the bit inserts in the storage device and allows a user to squeeze the grip

BRIEF DESCRIPTION OF THE DRAWINGS

The novel features of the invention are set forth in the appended claims. However, for the purpose of explanation, several embodiments of the invention are set forth in the following figures.

DETAILED DESCRIPTION

For the purpose of this disclosure, the word bit shall refer to any tool, device, accessory or the like which is normally associated with hand tools, wrenches, drills or the like, including, but not limited to, slotted screws, Phillips-Head screws and connections, pozidriv bits, torx bits, alien wrenches and screws, hex key bits, Robertson bits, tri-wing bits, torq-sets, spanner bits, drill bits, sockets of various shapes and sizes or the like.

Figure 1A:
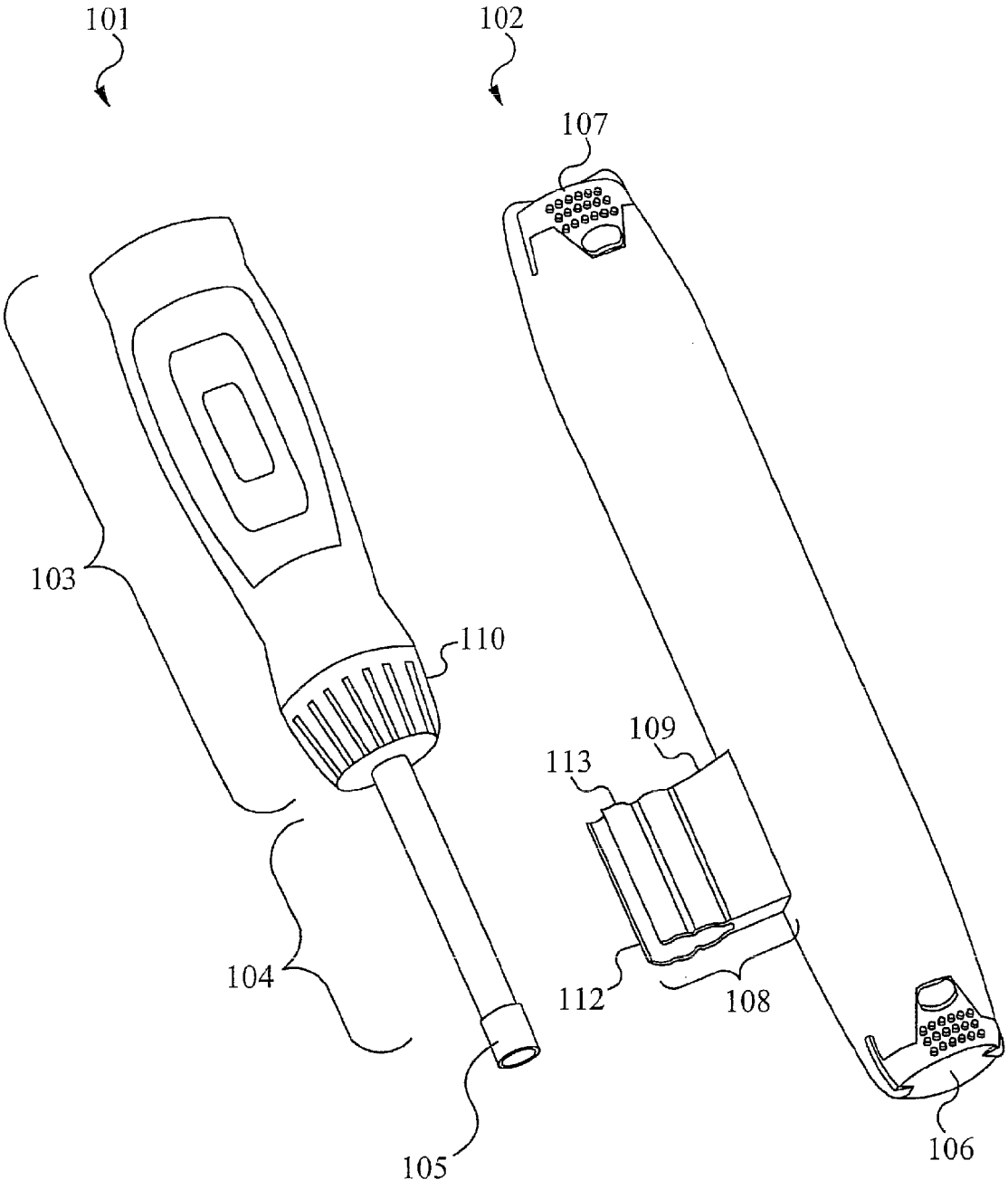
FIG. 1A illustrates a perspective view of the hand tool and bit storage device according to one embodiment of the present invention.

FIG. 1A provides a perspective view of a hand tool 101 and a bit storage device 102 according to some embodiments of the present invention. The hand tool 101 has a body portion 103, a stem portion 104 and a bit interface 105.

The body portion 103 is designed to comfortably fit in a user's hand and also to provide torque on the bit interface in an amount needed for common applications in carpentry, electronics, mechanics and the like. The stern portion 104 is coupled to the body portion 103 and to the bit interface 105. In some embodiments of the present invention, the stem portion 104 is thinner than the body portion 103 to allow the stem portion 104 and the bit interface 105 to fit into smaller spaces than the body portion 103 in order to access work pieces, while still allowing the user to exert adequate torque on the work pieces from a distance.

In some embodiments of the present invention, the hand tool also includes a ratchet device (not shown) and a ratchet housing 110. The ratchet housing 110 rotates around the axis of the stem portion 104 by some arc to toggle between clockwise and counterclockwise driving. When the ratchet housing 110 is positioned at one end of the arc, the ratchet allows the stem portion 104 the bit interface 105 to rotate in the clockwise direction, thus driving standard screws or tightening standard bolts. In such a position, a counter-clockwise rotation does not turn the stem portion 104. When the ratchet housing 110 is positioned at the other end of the arc, the ratchet allows the stem portion 104 and the bit interface 105 to rotate in the counter-clockwise direction, thus retracting standard screws or loosening standard bolts. In such a position, a clockwise rotation does not turn the stem portion 104.

The bit storage device 102 includes a fixture 108. The stem portion 104 of the hand tool 101 couples with a bit storage device with a fixture 108. As shown, the fixture 108 is a pressure fixture comprised of two flanges 112, 113 extending from the base 109 of the fixture 108. However, it will be appreciated by those skilled in the art that other means for coupling the hand tool to the bit storage devices are contemplated including, but not limited to straps, slots, hook and loop fasteners, snaps, and tongue and groove configurations. In other embodiments, the hand tool 101 and bit storage device 102 are not coupled, but are each designed to fit into an especially designed carrying case, box or pouch.

The bit storage device 102 is a substantially hollow structure with two removable storage tools 106, 107 inserted within the structure. The removable storage tools hold bits (not shown) which couple with the bit interface 105. The hand tool with accessory storage according to the embodiment shown in FIG. 1A allows the user to access a hand tool 101 and easily access and change bits (not shown) as dictated by the project being worked on.

Figure 1B:
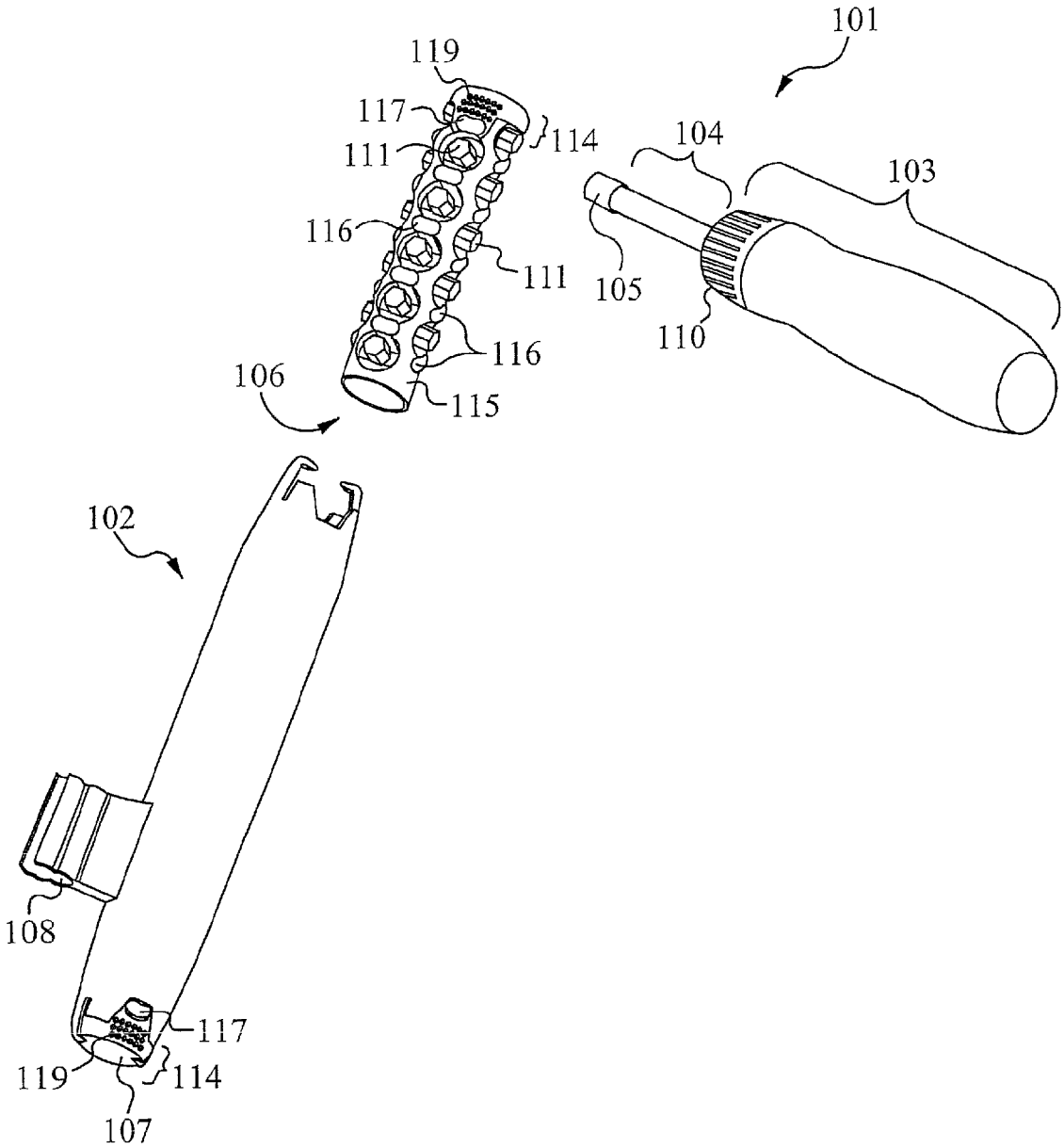
FIG. 1B illustrates a perspective view of the hand tool and bit storage device with hand tool interacting with a removed bit insert.

FIG. 1B shows the hand tool 101 and bit storage device 102 with the removable bit storage tool 106 removed. The removable bit storage tool 106 contains a number of bits 111. As shown, the bits 111 each have hexagonal interfaces for interfacing with the bit interface 105. It will be apparent to those skilled in the art that other shapes for interfacing between the bits and bit interface is contemplated. In some embodiments of the present invention, a 6.6 mm hex bit interface is used. In other embodiments, a 0.25 inch hex bit interface is used. Although specific sizes and shapes for the bit interface have been disclosed, it will be readily apparent to those skilled in the art that any other sizes and shapes for the bit interface are contemplated.

FIG. 1B also shows the storage tool frame cap 114 on the bit storage tool 106. The storage tool frame cap 114 is slightly larger than the circumference of the bit storage tool 106 so that a user can easily grip the frame cap 114. The storage tool frame cap 114 also has protrusions 119 situated on its surface to provide friction to a user accessing the storage tool frame cap 114. Furthermore, the storage tool frame cap 114 is coupled to a cap node 117. The cap node 117 aides in retaining the bits 111 within the bit storage tool 106, as will be explained in more detail when referring to FIG. 4.

Figure 2A:
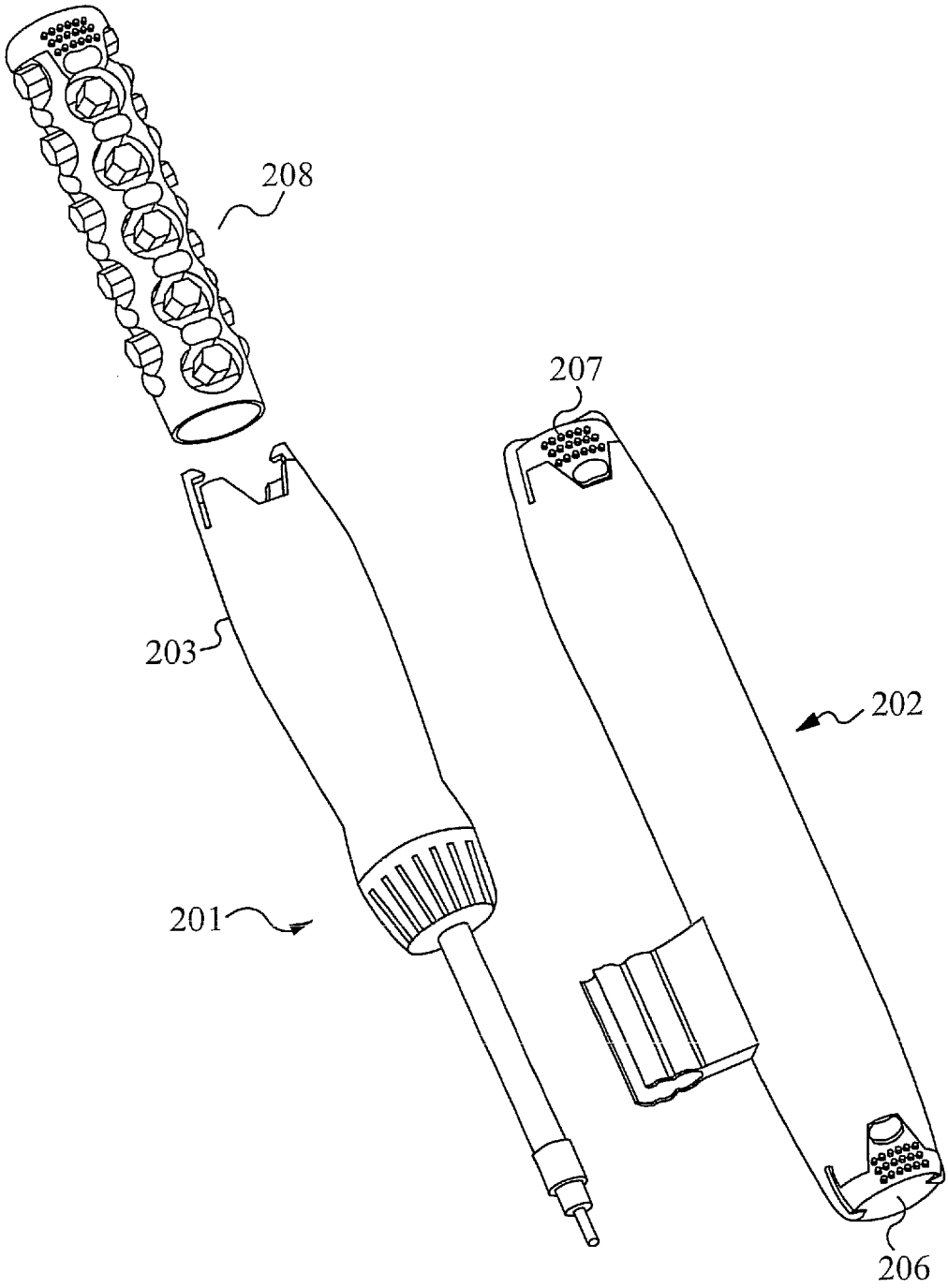
FIG. 2A illustrates a perspective view of the hand tool and bit storage device according to another embodiment of the present invention.

FIG. 2A provides a perspective view of another embodiment of the present invention with a hand tool 201 which accommodates a removable bit storage tool 208 and a bit storage device 202. In this embodiment, the body 203 of the hand tool 201 is substantially hollow and accommodates a removable bit storage tool 208. As shown, the bit storage device 202 holds the removable bit storage tools 206 and 207. However, the removable bit storage tools 206, 207 and 208 are interchangeable and are able to be held within either the storage device 202 and the body 203.

Figure 2B:
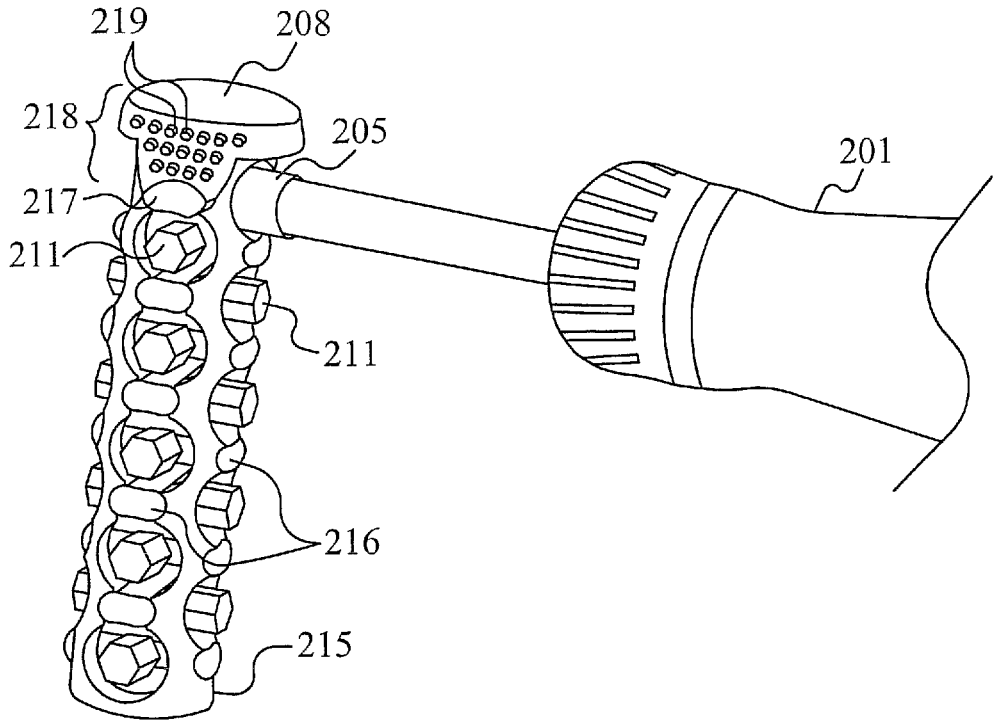
FIG. 2B illustrates a close up view of the bit insert and bit interface according to some embodiments of the present invention.

FIG. 2B shows details of the removable bit storage tool 208. The basic structure of the bit storage tool 208 is a semi-rigid polymer, which forms the frame 215 of the storage tool 208. The frame 215 is connected in spots by nodes 216. In some embodiments, the nodes 216 are more flexible than the frame 215. In the preferred embodiment, the nodes 216 are comprised of a resilient polymer. The frame 215 is connected by the nodes 216 to form a number of holes to accommodate the bits 211. The bits 211 are inserted into the holes and are held in place through friction exerted on the bits by the frame 215 and the nodes 216. It is preferred that a certain threshold of force be applied to the bits 211 to remove them from the bit storage tool 206. This threshold is preferably greater than the bits' 211 force due to gravity and also small forces created by normal jostling of the bit storage tool 208.

To remove the bits 211 from the bit storage tool 208, a user is able to manually push the bit from the side of the frame 215. Alternatively, a user is able to use the hand tool 201 itself as a bit insertion and extraction means. Using the hand tool 201 as a bit insertion and extraction means simply requires a user to hold the bit storage tool 208 with one hand and insert the bit interface 205 coupled with a bit into an empty portion of the frame 215 with the other. The user is then able to pull the hand tool out of the frame 215 while leaving the bit coupled to the frame 215. Additionally, to couple the hand tool 201 with a bit, a user is able to access a bit 211 from the frame 215 by coupling the bit interface 205 with a bit 211 and pulling the bit 211 from the frame 215.

These features give the user the ability to install and remove bits 211 directly from the bit insert frame 215 without ever putting down the hand tool 201 and without having to reach for a bit holder. This features allows the interchanging of bits in fewer steps, with fewer motions and with less of a risk of losing or dropping bits. As such, this configuration is superior to "loose bit" systems which require additional steps and present additional challenges, as described above.

In some embodiments, a user is able to squeeze one or more nodes 216 adjacent to a particular bit to aid in removing the bit from the frame 215. Squeezing the nodes 216 causes the shape of the frame 215 and the shape of the holes to distort. Such distortion allows easier access to the bits 211.

Another flexible polymer node comprises a cap node 217 coupled to a finger grip 218 at the top of the bit storage tool 206. The surface of the finger grip 218 contains a number of protrusions 219 to ensure friction between the user's finger and the finger grip 218. Squeezing the cap node 217 distorts the shape of the top of the bit storage tool 208, allowing easier removal of the bit storage tool 208 from the bit storage device 202. The bit storage tools 206 and 207 (FIG. 2A) is also removable from the bit storage device 202, and bits are likewise removable from bit storage tools 206 and 207 in a similar manner.

FIG. 2B also illustrates how the hand tool 201 with the bit interface 205 interfaces with the bit storage tool 208 and the bits 211. The bit interface 205 is designed to fit tightly over the bit 211. In some embodiments of the present invention, the bit interface 205 contains a magnetic core. The magnetic core creates a stronger bond between the bit 211 and the bit interface 205. The magnets chosen for the magnetic core may be selected from among: Ferrite Magnets, Neodymium Magnets, Samarium-cobalt Magnets, Ceramic Magnets and Alnico Magnets, among others. The user is able to push the bit 211 from the other side of the frame 215 to remove the bit 211 or can put pressure on a node 216 adjacent to the bit, as described above.

Furthermore, both ends of the bits 211 are able to be seen accessed from the sides of the bit storage tool 208. As such, a user can "test fit" the bit 211 with a particular screw or other work piece without first removing the bit 211 from the frame 215. This feature further saves the user the time required to fit a screw or other work piece of an unidentifiable size with the correct bit.

In some embodiments, each bit storage tool houses a different type of bit such as: slotted bits, phillips bits, pozidriv bits, torx bits, hex key bits, robertson bits, tri-wing bits, torq-sets, spanner bits or star bits. According to this embodiment, three different types of bits are stored and immediately accessible to the user of one tool.

Figure 3:
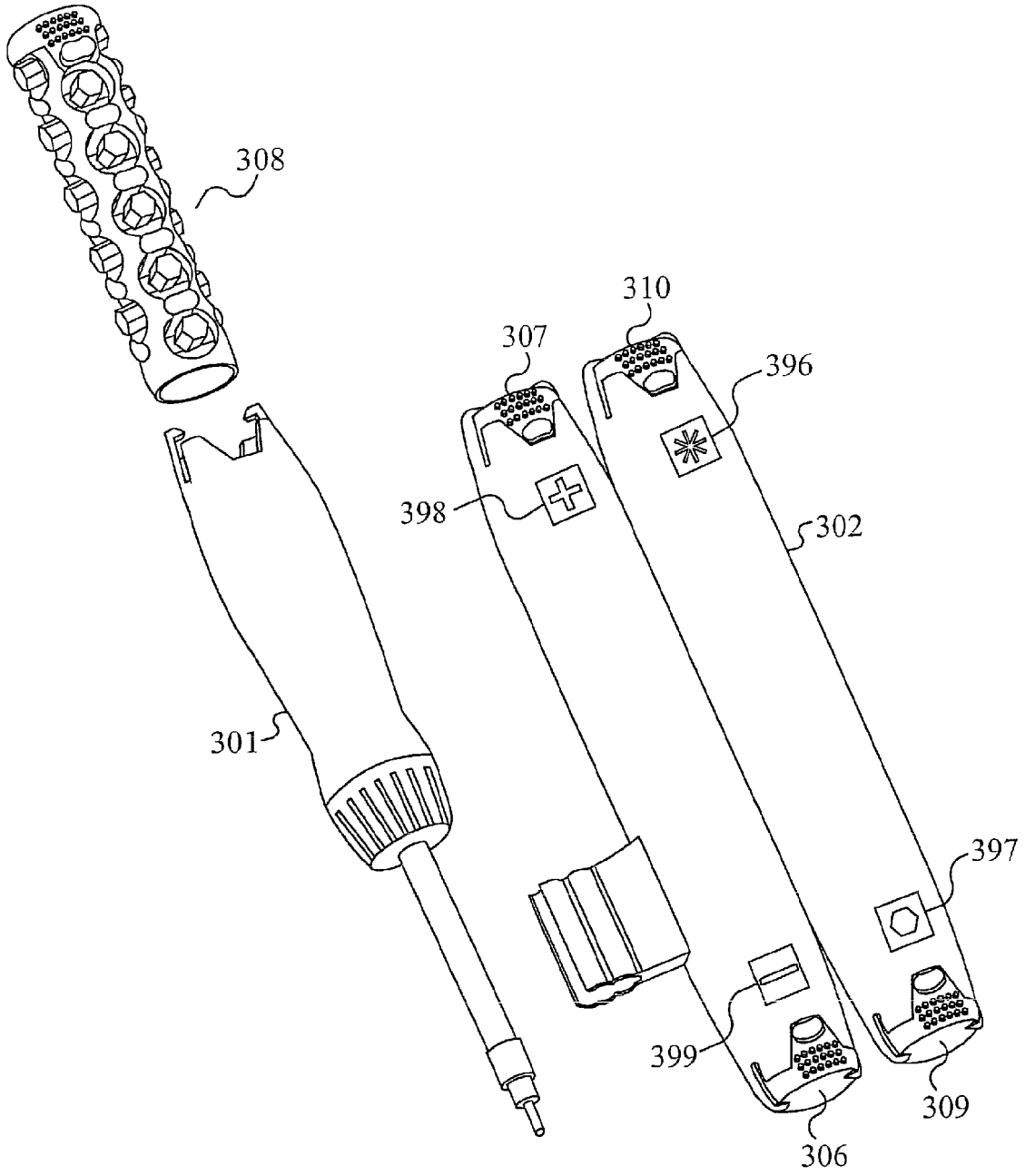
FIG. 3 illustrates a perspective view of the hand tool and bit storage device according to yet another embodiment of the present invention.

FIG. 3 provides a perspective view of yet another embodiment of the present invention. Here, a hand tool 301 with a removable bit storage tool 308 couples with a bit storage device 302. The bit storage device 302 holds four bit storage tools 306, 307, 309, 310. As such, the embodiment shown is able to store five bit storage tools allowing a user to have a very wide variety of tools immediately accessible. In some embodiments, pictures, words, symbols, colors or similar identifying markings are marked on the body of the bit storage device and depict the contents of each of the bit storage tools. FIG. 3 depicts symbols on the body of the bit storage device which depicts the contents therein. Symbol 399 shows that bit storage tool 306 contains slotted screw bits. Symbol 398 shows that bit storage tool 307 contains Phillip's head screw bits. Symbol 397 shows that bit storage tool 309 contains alien bits. Symbol 396 shows that bit storage tool 310 contains star bits.

In other embodiments of the present invention, markings on the body of the bit storage device or on the body portion of the hand tool indicate whether the bits contained therein are either American sized or metric.

Figure 4:
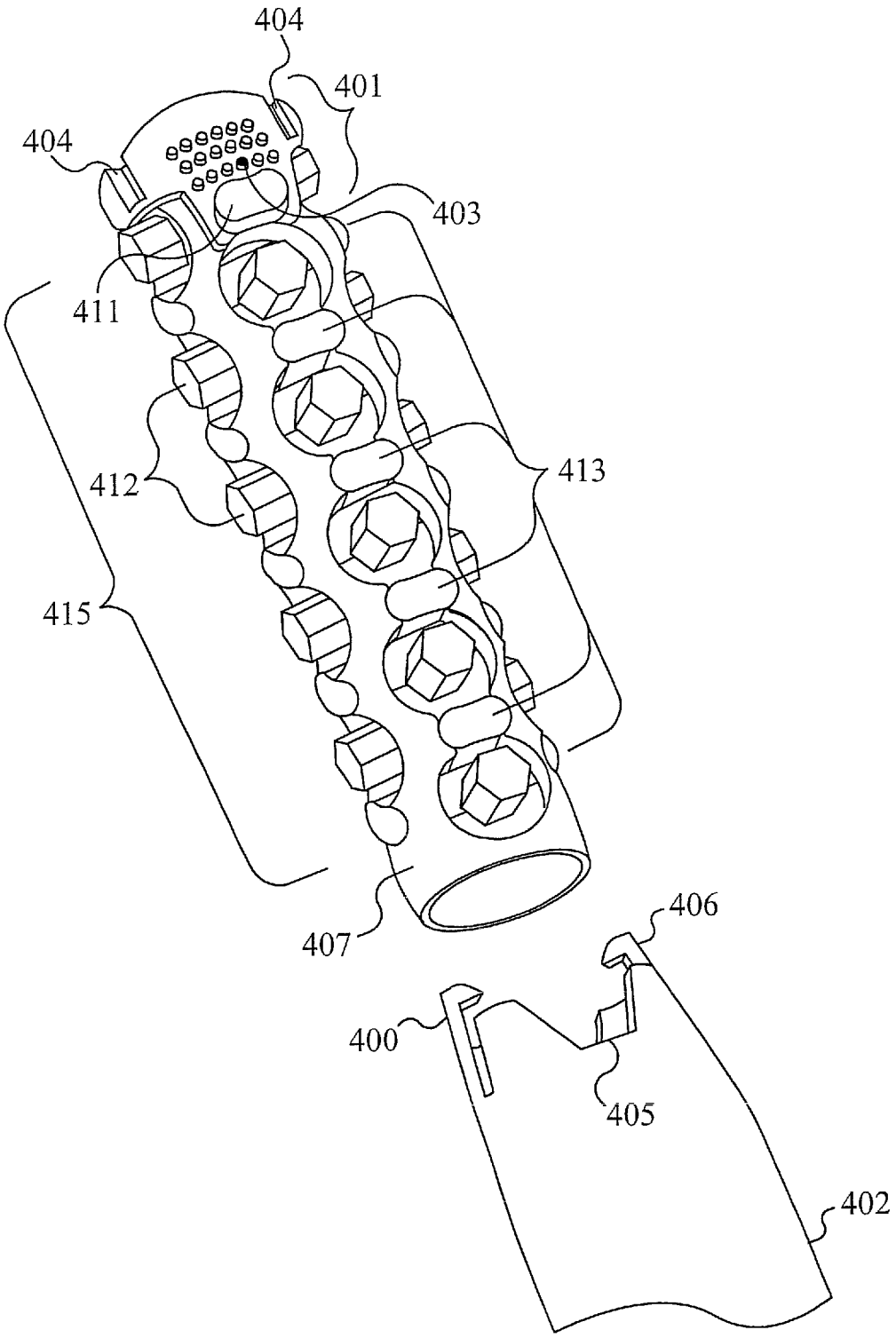
FIG. 4 illustrates a perspective view of the locking system used with the hand tool and bit storage device according to some embodiments of the present invention.

FIG. 4 illustrates another embodiment of the present invention in which the removable bit storage tools lock into the bit storage device or the hand tool. In FIG. 4, a close up of a removable bit storage tool 407 is shown entering a bit storage device 402. The bit storage tool 407 has a frame portion 412 and a frame cap 401 with finger grip protrusions 403. The frame cap 401 which protrudes further out than the rest of the frame portion 412. Adjacent to frame cap 401 are cap nodes 411.

The bit storage device 402 has an opening to hold the bit storage tool 407. The opening in the bit storage device 402 contains spaces 405 to accommodate the nodes 411 of the frame cap 401. Further, the opening features two semi-flexible and resilient clips 406. When the bit storage tool 407 is inserted into the bit storage device, the bit storage tool 407 passes over the rounded ends of the clips 406, causing the clips 406 to bend out. When positioned correctly, the clips 406 fit into the grooves 404 when the bit 407 is fully inserted, thereby locking the bit storage tool 407 into the bit storage device 402.

In some embodiments, the cap nodes 411 help a user insert bits into the frame 415 and remove bits 412 from the frame 415. According to these embodiments, the cap nodes 411 are composed of a more flexible material than the rest of the upper portion 401. In the preferred embodiment, the cap nodes 411 are comprised of a resilient polymer. When pressure is applied to the cap nodes 411, the shape of frame 415 and the shape of the nodes 413 distort, causing the holes to change shape. As pressure is applied or removed from the cap nodes 411, the holes are either tightened or loosened. When the holes are tightened, a user is able to exert enough force on the bits 412 from the bit interface (not shown) to couple the bit 412 to the bit interface from one side of the frame without forcing the bit 412 to come out the other side of the frame 415. A user is then able to release some pressure from the cap node 411, causing the holes to loosen. When the holes are loose enough, the user is able to remove the bit 411 from the frame 415 by pulling the bit interface away from the hole. As such, the cap nodes allow a user to change bits without requiring them to set down the hand tool and use two hands as they do in a "loose bit" application.

The present invention, as disclosed, provides significant advantages over traditional tools and tool storage systems. First, unlike "loose bit" tools, the present invention allows a user to change bits without ever having to put their tool or work pieces aside. Furthermore, the present invention allows a user to change bits with fewer steps and motions and limits the potential for dropping or losing bits.

Furthermore, the present invention cuts down the cost of buying tools. Using the hand tool and bit storage tools and holders of the present invention eliminates the need to purchase individual hand tools with each particular fitting. For example, the present invention eliminates the need for multiple sized flat head hand tools and the need to buy both a flathead and a phillips head hand tool because the present invention is able to hold all of them. For instance, the bit storage tools are able to hold various sized slotted screws, Phillips-Head screws and connections, pozidriv bits, torx bits, allen wrenches and screws, hex key bits, Robertson bits, tri-wing bits, torq-sets, spanner bits, drill bits, sockets of various shapes and sizes or the like. Also, those skilled in the art will appreciate that the removable bit storage tools are able to hold a wide variety of other tools.

The present invention also serves to conserve space and simplify organizing. The need to organize multiple hand tools of various sizes and shapes, alien wrenches, sockets, and the like on a tool bench or in a tool box is eliminated. With the present invention, all the bits required are able to be stored easily and are easily organized in a user friendly fashion. For example, one removable bit storage tool might hold metric sized alien bits and another bit storage tool might hold American sized allen bits. Furthermore, a third removable bit storage tool might hold star bits. The storage tools are able to be labeled with printed words, color-coated, labeled with pictures of the bits they contain, or otherwise identified.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device and method of the present invention could be implemented in several different ways and have several different appearances.

We claim:

1. A bit storage tool comprising:

at least one bit; and a tool frame centered about a first axis and including at least one hole for holding the at least one bit and at least one node extending into the tool frame, wherein the at least one hole is positioned on a line parallel to a second axis and perpendicular to the first axis, and further wherein the at least one hole comprises a first covered opening in a surface of the tool frame, a second covered opening in the surface of the tool frame and a covered conduit through the tool frame that holds the at least one bit, the covered conduit coupling the first covered opening to the second covered opening, wherein when the at least one bit is held within the covered conduit, the covered conduit covers an entirety of an outer circumference of the at least one bit and wherein the at least one bit is removed from the covered conduit through the first covered opening or the second covered opening, and further wherein applying pressure to the at least one node causes distortion of the at least one hole allowing removal of the at least one bit.

2. The bit storage tool according to claim 1, wherein the tool frame includes a plurality of holes and a plurality of nodes and wherein each of the plurality of holes holds a bit.

3. The bit storage tool according to claim 2, wherein the plurality of holes are situated on multiple sides of the tool frame.

4. The bit storage tool according to claim 1, further comprising a frame cap coupled to the tool frame, and a cap node coupled to the frame cap, wherein the cap node is configured to distort the at least one hole when pressure is applied to the cap node.

5. The bit storage tool according to claim 4, the frame cap further comprising a finger grip, wherein the finger grip is textured to provide a secure grip on the frame cap.

6. The bit storage tool according to claim 1, wherein the at least one bit is selected from among slotted bits, Phillips-Head bits, pozidriv bits, torx bits, allen wrench bits, hex key bits, Robertson bits, tri-wing bits, torq-sets, spanner bits, drill bits, and sockets of various shapes and sizes.

7. A bit storage tool comprising:

at least one bit; and a tool frame including a plurality of holes for holding the at least one bit and a plurality of nodes extending into the tool frame, wherein each of the plurality of holes comprises a first covered opening in a surface of the tool frame, a second covered opening in the surface of the tool frame and a covered conduit through the tool frame that holds the at least one bit, the covered conduit coupling the first covered opening to the second covered opening, wherein the at least one bit is removed from the covered conduit through the first covered opening or the second covered opening, and further wherein applying pressure to one of the plurality of nodes causes distortion of a corresponding hole allowing removal of the at least one bit, wherein the tool frame is centered about a Y-Y axis, wherein the plurality of holes are successively positioned down a length of the tool frame, wherein the successively positioned plurality of holes are alternatively positioned on lines parallel to an X-X axis and a Z-Z axis, and further wherein the lines pass through the Y-Y axis.

8. A bit storage tool and holder comprising:

a bit storage tool holder assembly with at least one aperture; and at least one bit storage tool comprising:

at least one bit; and a tool frame centered about a first axis and including at least one hole for holding the at least one bit and at least one node extending into the tool frame, wherein the at least one hole is positioned on a line parallel to a second axis and perpendicular to the first axis, and further wherein the at least one hole comprises a first covered opening in a surface of the tool frame, a second covered opening in the surface of the tool frame and a covered conduit through the tool frame that holds the at least one bit, the covered conduit coupling the first covered opening to the second covered opening, wherein when the at least one bit is held within the covered conduit, the covered conduit covers an entirety of an outer circumference of the at least one bit and wherein the at least one bit is removed from the covered conduit through the first covered opening or the second covered opening, and further wherein applying pressure to the at least one node causes distortion of the at least one hole allowing removal of the at least one bit.

9. The bit storage tool and holder according to claim 8, wherein the tool frame includes a plurality of holes and a plurality of nodes and wherein each of the plurality of holes holds a bit.

10. The bit storage tool and holder according to claim 9, wherein the plurality of holes are situated on multiple sides of the tool frame.

11. The bit storage tool and holder according to claim 8, wherein the bit storage tool further comprises a frame cap coupled to the tool frame and a cap node coupled to the frame cap, wherein the cap node is configured to distort the at least one hole when pressure is applied to the cap node.

12. The bit storage tool and holder according to claim 11, the frame cap further comprising a finger grip, wherein the finger grip is textured to provide a secure grip on the frame cap.

13. The bit storage tool and holder according to claim 8, wherein the at least one bit is selected from among slotted bits, Phillips-Head bits, pozidriv bits, torx bits, allen wrench bits, hex key bits, Robertson bits, tri-wing bits, torq-sets, spanner bits, drill bits, and sockets of various shapes and sizes.

14. A bit storage tool and holder comprising:

a bit storage tool holder assembly with at least one aperture; and at least one bit storage tool comprising:

at least one bit; and a tool frame including a plurality of holes for holding the at least one bit and a plurality of nodes extending into the tool frame, wherein each of the plurality of holes comprises a first covered opening in a surface of the tool frame, a second covered opening in the surface of the tool frame and a covered conduit through the tool frame that holds the at least one bit, the covered conduit coupling the first covered opening to the second covered opening, wherein the at least one bit is removed from the covered conduit through the first covered opening or the second covered opening, and further wherein applying pressure to one of the plurality of nodes causes distortion of a corresponding hole allowing removal of the at least one bit, wherein the tool frame is centered about a Y-Y axis, wherein the plurality of holes are successively positioned down a length of the tool frame, wherein the successively positioned plurality of holes are alternatively positioned on lines parallel to an X-X axis and a Z-Z axis, and further wherein the lines pass through the Y-Y axis.

15. A bit storage tool comprising:

a plurality of bits; and a tool frame centered about a first axis including a plurality of holes for holding the plurality of bits and a plurality of nodes extending into the tool frame, wherein the plurality of holes are positioned on a line parallel to a second axis and perpendicular to the first axis, and further wherein each of the plurality of holes comprises a first covered opening in a surface of the tool frame, a second covered opening in the surface of the tool frame and a covered conduit through the tool frame that holds the a corresponding one of the plurality of bits, the covered conduit coupling the first covered opening to the second covered opening, wherein when the corresponding one of the plurality of bits is held within the covered conduit, the covered conduit covers an entirety of an outer circumference of the corresponding one of the plurality of bits and wherein the corresponding one of the plurality of bits is removed from the covered conduit through the first covered opening or the second covered opening, and further wherein applying pressure to a corresponding one of the plurality of nodes causes distortion of a corresponding one of the plurality of holes allowing removal of the corresponding one of the plurality of bits.

16. The bit storage tool according to claim 15, wherein first axis is a Y-Y axis and the second axis is an X-X axis, wherein the plurality of holes are successively positioned down a length of the tool frame, wherein the successively positioned plurality of holes are alternatively positioned on lines parallel to the X-X axis and a Z-Z axis, and further wherein the lines pass through the Y-Y axis.

* * * * *